US006139445A

United States Patent [19]

Werner et al.

[11] Patent Number: 6,139,445

[45] Date of Patent: Oct. 31, 2000

[54] GOLF CLUB FACE SURFACE SHAPE

[75] Inventors: Frank D. Werner, Box SR9, Jackson, Wyo. 83001; Richard C. Greig, Jackson, Wyo.

[73] Assignee: Frank D. Werner, Teton Village, Wyo.

[21] Appl. No.: 09/134,406

[22] Filed: Aug. 14, 1998

[51] Int. Cl.[7] ..... A63B 53/04

[52] U.S. Cl. ..... 473/330; 473/331

[58] Field of Search ..... 473/409, 330, 473/331, 324, 305, 313, 314, 340, 341, 342

[56] References Cited

U.S. PATENT DOCUMENTS

| | | | |
|---|---|---|---|
| D. 350,800 | 9/1994 | Ota | D21/220 |
| 1,188,479 | 6/1916 | Park . | |
| 1,615,038 | 1/1927 | Reuter, Jr. . | |
| 1,673,994 | 6/1928 | Quynn . | |
| 3,989,257 | 11/1976 | Barr | 273/175 |
| 4,367,878 | 1/1983 | Schmidt | 273/175 |
| 4,416,825 | 11/1983 | Sasse | 273/175 |
| 4,471,961 | 9/1984 | Masghati et al. | 273/175 |
| 4,508,349 | 4/1985 | Gebauer et al. | 273/175 |
| 4,521,022 | 6/1985 | Schmidt | 273/175 |
| 5,333,873 | 8/1994 | Burke | 273/175 |
| 5,681,228 | 10/1997 | Mikame et al. | 473/330 |
| 5,830,075 | 11/1998 | Hirose | 473/313 |
| 5,857,922 | 1/1999 | Delio | 473/313 |

OTHER PUBLICATIONS

"The Clubmaker's Art: Antique Gold Clubs and their History" by Zephyr Productions, Inc., Jan. 1997.

*Primary Examiner*—Kien T. Nguyen

*Attorney, Agent, or Firm*—Westman, Champlin & Kelly, P.A.

[57] ABSTRACT

Golf club heads are disclosed which have face surface shapes which are designed so as to reduce the scatter of the points where the ball stops after a hit, as compared to face surface shapes of prior art. This is accomplished by use of optimum face surface shapes which respect the USGA requirement for no degree of concavity. The face surface shapes disclosed are different in upward directions from the hit center to the face surface shapes in downward directions.

15 Claims, 4 Drawing Sheets

GOLF CLUB FACE SURFACE SHAPE

BACKGROUND OF THE INVENTION

This invention relates to improvements in the shape of the surface of the hitting face of a golf club which minimize the dispersion of the locations where the golf ball stops after a hit. This invention reduces the ill effects of human errors in hitting a golf ball.

BACKGROUND DEFINITIONS

The following abbreviations and definitions are used in this specification. All pertain specifically to golf and golf clubs, with the exceptions of curvature, cylinder, and symmetry. Other terms used in the specification are defined where needed.

Bulge radius means the radius of the face which causes the central part of the face to "bulge" forward when considered from toe to heel.

CHD means center hit distance which is the distance the ball travels when hit at the hit center (defined below) when all golfer variables are at their mean values, i.e., an error-free hit. CHD includes flight plus bounce and roll.

Curvature and radius of curvature refer to the curvature of a line which is usually a line of intersection of a cutting plane with a surface such as the face, said cutting plane usually being perpendicular to said surface. The mathematical definition of radius of curvature, a term often used herein, is the reciprocal of the curvature. Thus a strongly curved line has a small radius of curvature and a slightly curved line has a large radius of curvature. Curvature or radius of curvature may vary along the line of intersection.

Cylinder means the surface traced by a straight line, called element, moving parallel to a fixed straight line. Its path of motion is usually not along a straight line. It is used in a general sense so that a cylinder is often not a circular cylinder and its path of motion may or may not be a closed curve, that is, it may be an "open" cylinder.

Face means the hitting face or hitting surface of a golf club.

Face shape or face surface shape refers to the shape of the face surface as opposed to the outline (periphery or perimeter) of the face.

Hit center or hit center point is the point on the club face where a golfer should try to center hits. It is at or near the geometric center of the face of a driver. For a fairway wood, an iron, or a putter, a tee is not used, so the upper part of the face normally has no hits. For these clubs, the hit center is midway between the toe and heel ends of a hitting zone (defined below) and midway between the top and bottom of said zone. The hit center is commonly considered to be the "sweet spot" for hits.

Hitting zone for irons, putters, and fairway woods is the zone within that part of the club face which is between the lower boundary below which the imprint area is excessively distorted because its lower portion is truncated by the lower edge of the face, and the upper boundary above which the lower edge of the club digs into the turf excessively.

LA means loft angle. LA is measured in a vertical plane which passes through the hit center and is perpendicular to the face surface at the hit center. The intersection of this plane and the face surface on a driver with a curved face forms a curved line in the plane. Also in this vertical plane is a line tangent to the face at the face center. LA is the acute angle between a vertical line in the vertical plane and that tangent line. In some cases the term "local LA" is used, which is similarly defined but it is for a point on the face surface other than the hit center.

Mid plane is a plane perpendicular to a tangent plane which is tangent to the face at its hit center and these two planes intersect in a line which is horizontal and passes through the hit center.

Optimum face shape as used herein is that shape which minimizes the scatter of stop points (defined below) of many hits by an actual golfer. The scatter in statistical terms is measured as the standard deviation of the radial distance of stop points from the stop point of the center hit. It could be defined as the mean value of the deviations or in other ways, but results would be similar to the present definition for comparing different face shapes if the definition selected is based on other reasonable measures of scatter. The term "optimum" shape is sometimes used interchangeably with "best" shape Roll radius is similar to bulge radius but refers to up-down radius of curvature rather than toe-heel.

Stop point means the point on a level normal fairway or the green where the ball comes to rest after a hit.

Sweet spot. See "hit center".

Symmetric as used here refers to a surface which has a reflection in a plane of symmetry and said reflection appears identical with said surface beyond said plane. An example is a right circular cylinder which is symmetric with respect to a plane at right angles to its axis and is not symmetric if such plane is not at right angles to the cylinder's axis.

PRIOR ART

U.S. Pat. No. 4,508,349 to Gebauer et al, describes a golf club with a central portion of the face having an accentuated roll radius of curvature preferably between 1 inch and 0.70 inch, with grooves along its upper and lower extremities. Extending above the upper groove is a flat portion and below the lower groove is also a flat portion. Greater distance for a drive is claimed. This design has concavity in some portions of the face, which is at odds with the United States Golf Association rule against "any degree of concavity" (page 22, "The Rules of Golf 1998–1999, USGA"). The various curvatures for the intersection line of a plane cutting the face at the hit center are the same in opposite directions from the center, as is the case with other prior art.

U.S. Pat. No. 5,333,873 to Burke discloses a putter having a flat face toward the heel end and a rearwardly curving face toward the toe end as shown in FIG. 1. This curved surface is said to reduce the errors caused by the golfer when "the putter is moved off center and is swung in an inexact arc". This curved surface is a part of a circular cylinder which is tangent to the face at the hit center.

U.S. Pat. No. 1,615,038 to J. Reuter shows a putter which has a flat area near the center of its face and is curved only at the toe and heel ends.

U.S. Pat. No. 4,521,022 to G. Schmidt describes a face surface for irons for which the surface is hyperbolic and symmetrical about a mid plane. The apex of this hyperbola is at the nominal location of the hit center.

Putters have been advertised which have the shape of a horizontal circular cylinder with a radius of about 0.5 inch such as in U.S. Pat. No. 2,665,909.

A variety of face surface shapes are shown on pages 239–261 inclusive, in the book, "The Clubmaker's Art: Antique Golf Clubs and their History", Jeffery B. Ellis, Zephyr Productions, Inc., copyright 1997. Numerous putters, irons, and woods are shown which have circular cylindrical face surfaces, all being oriented either vertically or horizontally, and some are concave. Pages 117 to 119 inclusive show irons which appear to have some degree of concavity. Pages 244 and 245 show 3 irons, 2 of which have 2 flat hitting surfaces. In both cases each flat surface has a different loft angle from the other. A third has 3 flat hitting surfaces. In all 3 cases, the flat surfaces are joined by cylindrical surfaces of small radius. All three cases have significant concavity. They are described further in British Patent Nos. 266 to Sharpe and 9884 to Park; and U.S. Pat. No. 1,188,479 to Park and U.S. Pat. No. 1,673,994 to Quynn Additional related U.S. Patents include: U.S. Pat. No. 2,665,909 to P. Wilson; U.S. Pat. No. 3,989,257 to S. Barr; U.S. Pat. No. 4,367,878 to G. Schmidt; U.S. Pat. No. 4,413,825 to H. Sasse; and U.S. Pat. No. 4,471,961 to M. Masghati et al. An article in "Golf Digest", July 1965, pp. 70–72 and 74–75 is also related.

The faces of drivers and fairway woods have been manufactured with a bulge radius for many years. These have always been of reasonably constant radius of curvature from the toe end of the face to the heel end. From the top to the bottom of a driver's face, the surface may be straight but a roll radius is usually used. It also has a constant radius of curvature.

The values of radii which achieve the best face shape for both bulge and roll depend strongly on the location of the center of gravity of the club head, among other things. The center of gravity for woods is generally located 0.5 to 1.5 inches behind the face. Irons differ greatly from woods with respect to location of their centers of gravity, since in an iron the center of gravity is located in or near the face. As a consequence, the faces of irons are generally flat in the usual commercial embodiment, and have no bulge or roll. A flat face for irons was formerly a requirement of the United States Golf Association (USGA) which was changed in recent years to allow curvature, so long as there is no degree of concavity. Driving irons are sometimes supplied with bulge and roll, even though they are called irons. Few golfers use driving irons.

The present inventors have designed prior-art face surface shapes which have been manufactured and sold in commerce and which have a surface shape which is part of a surface defined by equations of a torus. FIG. 12 of the present application shows a convex portion of such a shape. A club face outline is drawn on the surface. In some cases, the face outline is rotated at various angles around a major diameter at the indicated face center. This angle and the constants in the equation which define the radii of the surface are varied for minimum scatter of stop points.

All prior art face surfaces are symmetric about one or more planes which are perpendicular to the plane which is tangent to the face at its hit center. The putter of FIG. 1 of the present application is symmetric about such a plane, namely its mid plane as defined above. The equations of a torus yield such planes of symmetry, and minimum radius of curvature which is everywhere constant in the area of interest. The usual bulge and roll faces have two such planes of symmetry. Flat faces and face shapes which are hyperboloid and numerous other prior art shapes have shapes toward the toe which are the same as toward the heel. Some of the novel surfaces described in the present application have symmetry about a vertical plane, but never about the mid plane, and some have no symmetry of any kind.

SUMMARY OF THE INVENTION

The present invention relates to a golf club having a face surface shape which minimizes the scatter of the stop points of the ball after hits for typical golfers and does so more effectively than flat faces or face surface shapes of prior art.

In all forms of the invention the face shape, when examined at the intersection of the face with a cutting plane perpendicular to the face which is approximately vertical and passes approximately through the hit center, the curvature is different in the top portion of the face as compared to the bottom portion. There are also other differences and no part of the face has any degree of concavity.

The scatter of stop points is significantly less in the present invention for all irons except the longest if the lower portion of the face is curved around an approximately horizontal axis so that the face is convex to the desired degree. Such curvature for irons is preferably not constant for optimum face surface shape in many cases. Careful research revealed that best shape for the upper part of the face requires concave curvature in this upper part which is not allowed by USGA, so here, a flat surface is the best choice. The custom of equally curving both top and bottom portions so as to be convex, has detrimental effects caused by curvature of the upper portion, and the benefits of curving only the bottom portion were not available until the present invention was advanced.

In the case of woods where the center of gravity is not in or near the face, but is 0.5 to 1.5 inches rearward, a reverse situation applies, in which the upper part of an optimum face surface shape has convex curvature and the lower part is flat or nearly so. In this case, the benefit of curving only the upper portion was not known until the present invention was advanced.

The novel face surface shapes minimize the scatter of the stop points of the ball which results after numerous typical hits are considered, as compared with the scatter for an otherwise identical club of the usual face surface shape.

These face surface shapes are found by novel procedures. In one form, the face surface shape is described mathematically then the parameters in such mathematical descriptions are systematically adjusted until the scatter of stop points is minimized. The present invention is applicable to woods, irons, and putters.

DETAILED DESCRIPTION OF THE PREFERRED EMBODIMENTS

Figure 1:
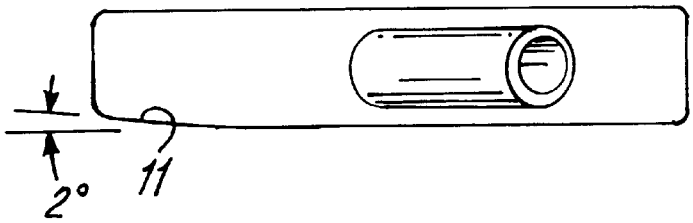
Fig. 1 PRIOR ART
FIG. 1 shows a prior art curved face of a putter as disclosed in U.S. Pat. No. 5,333,873.
Figure 2:
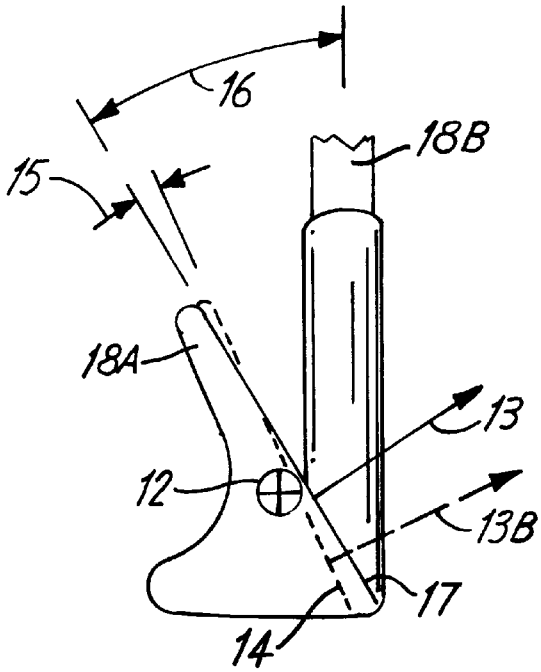
Fig. 2 PRIOR ART
FIG. 2 is an end view of a typical prior art golf iron.
Figure 3:
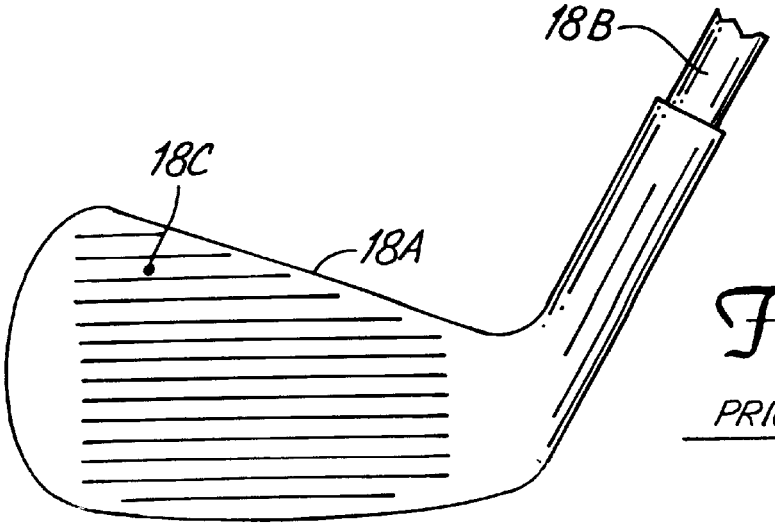
Fig. 3 PRIOR ART
FIG. 3 is a front view of a typical prior art golf iron.

FIGS. 2 and 3 show the toe end and face of a prior art golf iron, and illustrate the ball impact geometry. Initial flight of the ball is indicated by line 13, in FIG. 2 for a hit at the hit center location. The center of impact is where line 13 intersects club face 17. Line 13 is approximately perpendicular to club face 17. The center of gravity location is 12, and when the impact is below the center of gravity, as at 13B, the club face will rotate through an angle shown at 15, due to the impact force. This angle 15 is generally quite small, and is exaggerated in FIG. 2 for illustration. Less momentum and thus less speed is transferred from the club head to the ball when the hit is well below the center of gravity than when it is centered near the center of gravity, because part of the momentum is converted to angular motion of the club head. The club shaft 18B is able to twist or to bend or flex somewhat and begins to flex during the very short duration of impact, which is about 0.0005 second. In this way the head 18A can rotate slightly, gaining angular velocity, and building up angular momentum, which results in reduced ball velocity.

On the shorter irons, it is impractical for the center of gravity to be as low as the hit center, with the result that most or all hits are below the center of gravity. The farther the hit is below the center of gravity, the less distance it travels after the hit. Face surface shape for the present invention causes the local value of LA (loft angle) to become lower as distance of hits below the center of gravity increases thus increasing the distance and canceling this loss of distance.

Two Methods for Designing Face Surface Shapes

A prior art method of designing face surface shapes resulted in adjustment of bulge radius and of roll radius (which were defined above) such as to approximate optimum values. The present invention teaches adjustment of distinctly different parameters from bulge and roll radii and there may be from 2 to as many as 6 or more such parameters. Either method may be done experimentally or by mathematical (or analytical) processes.

The prior art process to find face surface shape (from which there may be variations) is to make a model of the club; make many hits at various measured positions on the club face; for each hit, measure the location of stop points on the fairway in distance and direction; then by experience, judge what changes in bulge radius and roll radius would reduce the scatter of stop points. After this experiment, a revised, similar model of the club is made using the new bulge radius and roll radius. The testing and revision process is repeated one or more times if judged worthwhile, seeking to further reduce the scatter.

An experienced designer understands two fundamental kinds of behavior of an off-center hit. If the local loft angle at the place of the off-center hit is too high or too low, a shot will not travel the same distance as for the proper loft angle; if the shot stops too far to the left (or right) at the place of the hit, the face shape is not oriented far enough toward the right (or to the left) at the place of the hit to counter this error. It is understood that if the roll radius is changed, the local loft angle is altered. If the bulge radius is changed, the local right-left orientation is altered. At least implicitly, the designer understands that the laws of geometry prevent completely independent adjustment of local loft angle and local face orientation direction. The designer understands by experience approximately how much the bulge and roll radius may best be changed to make the desired correction. Significant improvement is possible as compared to poor face designs, but that near perfect corrections are not possible. These relations are reasonably understood by skilled designers but designers often do not consciously consider each detail individually as they make decisions.

A golfer makes various errors in hitting, some of which affect these test hits. The present inventors have studied the major errors by means of numerous stroboscopic photos of numerous golfers and by marking tape on the club face. The largest of these errors in terms of causing the stop point to scatter, is that the golfer cannot rotate the wrists to exactly the same angular position on each hit, which alters the angular orientation of the head at the instant of impact. Two other important errors are hitting too high or low, or toward the toe or heel, from the desired location of the hit. In the desired final club designs of the present invention, face surface shape can reduce the effects of these errors. Other important errors are variations of the head speed at impact and variations of the direction of the path of the club head. There are many additional golfer errors. These errors are usually less important.

The process of measuring variations of stop points is improved and facilitated if the hits are made by using a "robot" golfing machine ("robot golfer"). Robot golfers reduce or eliminate most of these errors. It is common for improving the designer's judgment, to use imprint tape on the club face so that the location of each hit on the face can be measured, either for human golfers or for robot golfers.

The judgment process of the prior art can be replaced by analytical calculations. Statistical evaluations of the size of the scatter of stop points and systematic variation of bulge and roll radii of each club design variation made and tested to minimize the size of such scatter can be carried out.

All prior art methods discussed involve judging only 2 parameters, namely the bulge and roll radii, except the case of the torus, which involves 3 parameters.

As stated, the method of the present invention for determining face surface shape involves other variables. The variables include: (1) curvature of the surface shape going in one direction from the hit center, with no curvature going in the opposite direction from the hit center; and (2) the orientation of this curvature. It will be recognized that such curvature is actually the curvature of a cylindrical surface which has an axis (or more generally, line elements) at some specific angular orientation which is a preferred definition of the orientation of the curvature. The inventions define zero for this orientation to be a horizontal cylinder, positive direction being counterclockwise when viewed toward the front of the face. In this example there are two variables. Further, the present inventors allow the surface shape to be defined by the sum of deviation from flat for one or more such cylindrical surfaces, usually up to 3 such cylinders, each defined by two variables, all cylinders being tangent to the club face at the location of the center hit and having a chosen curvature in one direction from the center hit and no curvature in the opposite direction.

In the present invention the curvature toward the toe may be different from that toward the heel and allows similar differences in the up-down direction. This means that in such cases 4 parameters (4 different curvatures) can be judged. A still further set of beneficial adjustments are made with the present invention. The angular orientation of each of these 4 curvatures may vary. For example, at the toe part of the club face, the curvature may be greatest, not strictly toward the toe, but at whichever direction makes the greatest improvement. In such cases, there would be 8 different parameters (4 curvatures and 4 orientations).

In the case of golf driver heads the most important improvement is made when only 2 different curvatures are used, each at its optimum angular orientation. This means there are 4 parameters to be judged. Use of a 3rd curvature and a corresponding 3rd angular orientation is a small improvement in some cases and in other cases it is often of negligible importance. Use of a 4th or more curvatures usually is of negligible importance. In some cases, typically in the design of irons and putters, only one curvature and one corresponding angular orientation is required, additional ones being unimportant.

The above example of the surface shape of the present invention described above was based on circular cylindrical shapes. Inasmuch as cylinders may have other shapes than simple circular cross sections, sometimes shapes other than circular can be used. Examples include elliptical shapes, parabolic shapes, and exponential shapes. It was found that usually all such shapes are useful in ranges where they all approach circular cylindrical shapes rather closely.

The face surface shapes of the present invention may be arrived at by the same experimental observations and practiced judgment which was described above in connection with prior art, except the designer must learn to consider the other variables taught by the present invention in place of bulge and roll radii only.

Relation Between Surface Shape and Stop Points

The present inventors have carried out a mathematical analysis, based on their many years of research and their experiments with actual golfers which allow them to calculate the details of impact and the flight of the ball, for any specific design of club head, face surface shape, head speed, and position of the hit on the face of the club. This establishes the stop point for each hit. This process allows precise comparisons among various club head designs and face surface shapes. It also reveals the effects of small changes in design which are difficult to discern and study by the experimental measurements.

This mathematical process is further explained in a following section. It is usually preferred by the inventors over the experimental evaluation of face surface shape. The remainder of this section discusses the relationships, based on the mathematical analysis, but every result can be obtained by careful experiments.

Figure 4:
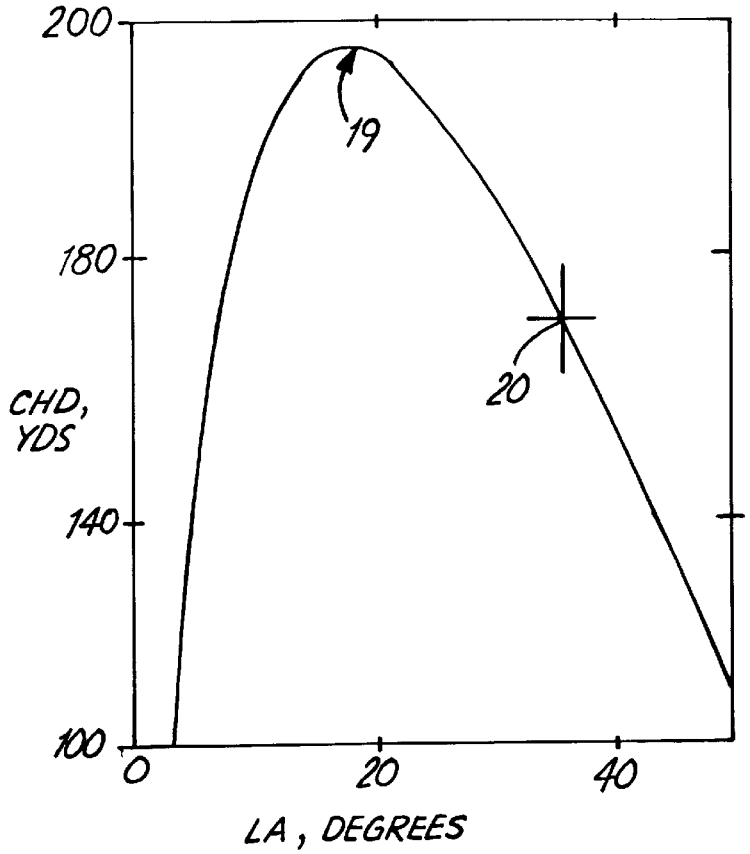
FIG. 4 is a graph showing how the center hit distance CHD varies for an iron if the loft angle LA is changed for a typical design with no other changes.
Figure 5:
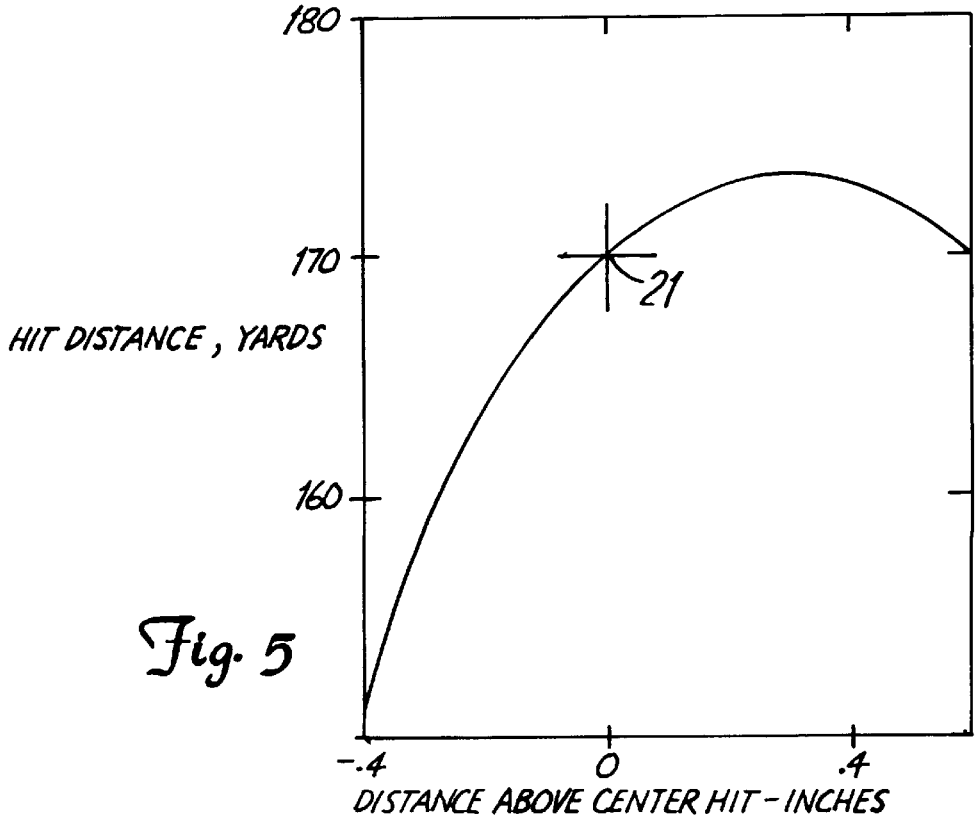
FIG. 5 is a graph showing how distance of a hit varies for hits which are vertically off the hit center for a typical design.

FIGS. 4 and 5 are graphical results based on mathematical analysis procedures. These figures show the fundamental reason why face curvature can adjust the distance of various hits, since face curvature changes the value of the local LA. The calculated results for an iron are shown in these figures for a particular selected combination of head weight, head speed and of the inertia values of the head. In FIGS. 4 and 5, typical design hit center locations are shown at 20 and 21, respectively.

Loft angle LA is the principal design parameter which is changed to provide design control over the ball travel distance for irons.

FIG. 4 shows that there is a value of LA which gives a maximum center hit distance CHD. In this example that value of LA is about 18° and is indicated at point 19 on the plot of FIG. 4, and the distance is also indicated on the vertical scale, being about 195 yards. For larger or smaller values of LA, the distance diminishes. LA is chosen for each iron so as to give a suitable distance for the shot, as guided by the effect of LA on CHD.

The point indicated by numeral 20 in FIG. 4 is a typical LA value for a six iron when used by a fairly strong golfer, giving CHD of 170 yards. A value of LA of about 7° would also give CHD of 170 yards, as can be found on the left branch (to the left of point 19) of the curve of FIG. 4. This left branch of the curve is not used because it causes a very low and short flight of the ball with a much longer bounce and roll distance after landing. The stop points are much more variable for this lower LA value branch to the left of point 19 than for the higher LA values of the right-hand branch.

FIG. 4 is a graph for a particular height of the hit center. Similar curves apply if the hit center location is located higher or lower, with the results mainly changing the maximum distance indicated at numeral 19.

When the impact center is above or below the hit center location, there is a somewhat similar effect on the distance of the hit. FIG. 5 shows this effect. The hit center location is assumed to be at 21. If the impact center of a hit is on this hit center location at 21, a ball travel distance of about 170 yards is realized. If it is 0.4 inch lower (at −0.4 in FIG. 5), the distance is only about 152 yards. For this particular example, the center of gravity is located such that hits which are somewhat above the hit center location give somewhat more distance, but after an increase above a certain value, also begin to give less distance.

For the example of a hit centered 0.4 inch too low, FIG. 4 suggests a corrective configuration to regain the desired distance of 170 yards. That is to change the face surface shape so as to reduce local LA of the club at the center of impact of the ball. When the corrective shape of the face is properly chosen, the distance of the hit can be made to be nearly constant when hits are below the hit center. Variation between hits may be reduced to the range of 2 to 3 yards, as compared with the distance shortfall as great as 18 yards for a hit at −0.4 inch, with no corrective face shape.

Hits which are rather far above the hit center location also need reduced local LA, but that would require a surface shape curving forward and having a concavity of the face, which is not acceptable. Thus, this part of the upper portion of the face is left flat for irons. The slope of the surface changes smoothly in the transition from one portion of the face to other portions having different curvature. The change in slope is without a discontinuity, which would appear as a ridge. For irons, scatter of stop points caused by this flat, uncompensated upper face can be substantially reduced by designing with a somewhat higher than usual center of gravity.

Another adverse condition is when the hits are toward the toe or heel from the hit center location, as well as being too high or too low. A study of face surfaces was conducted for irons which are flat above the hit center and curved so as to be convex below the hit center. The study approximated hits which are scattered randomly in the same manner as those measured on actual golfers. The study showed that curvature in the heel and toe direction was not helpful.

For woods, with more rearward center of gravity, hits toward the toe and heel were studied similarly, with comparable results, but details are different and involve aerodynamics of the spinning ball.

Mathematical Processes for Defining Shapes

The inventors have discovered that there are procedures for finding reliable approximations to optimum curved surfaces for golf clubs which minimize the scatter of stop points. As is described, experimental processes are possible but difficult. The inventors have evolved a mathematical analysis which is practical.

Both mathematical and experimental processes use curved surfaces which are called "modification surfaces" which provide the desired changes of local face shape. These modification surfaces define the distances which are to be added in a rearward direction to a flat golf club face surface in order to arrive at the desired, curved, final golf club face surface shape. The modification surfaces are defined mathematically as circular, elliptical, parabolic, hyperbolic, and exponential curved surfaces. Other mathematical curved surfaces could also be used. All are cylindrical in shape. For irons, large or infinite radii of curvature were best for the upper part of the face and small radii were best for the lower part, whereas for woods, the reverse is true. In some cases, it was advantageous for the radius of curvature to diminish somewhat as distance from the hit center increased; in others, the radius was constant or nearly so.

Figure 8:
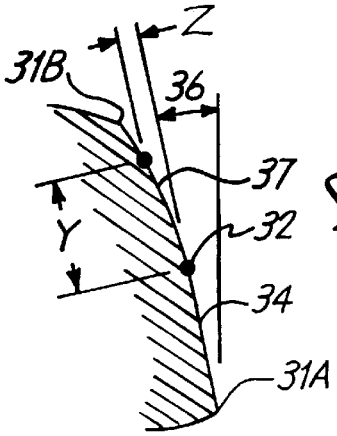
FIG. 8 is a fragmentary sectional view related to FIG. 7, and taken on line 8—8 in FIG. 7, where the sight plane is at an angle of 165° from a reference plane, and shows a typical face surface shape for woods embodying the present invention.
Figure 9:
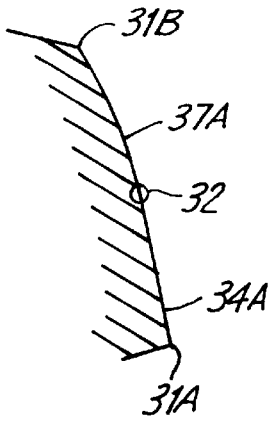
FIG. 9 is a fragmentary sectional view taken on line 9—9 in FIG. 7 which is rotated 15° from the reference plane.

An example of the mathematical description of one such surface will help to illustrate the general method. In the case of exponential surfaces, one form used is:

$$z=a0+a1*y\hat{}1+a2*y\hat{}2+ - - - +an*y\hat{}n,$$

where a0, a1, . . . an, are constants; "*" means to multiply; "^" means to raise to the power indicated; n is a number as large as desired; y is the distance from the hit center in a plane tangent to the face at the hit center and z is the distance to be added in a rearward direction as described above. Distances y and z are indicated in FIG. 8.

Figure 7:
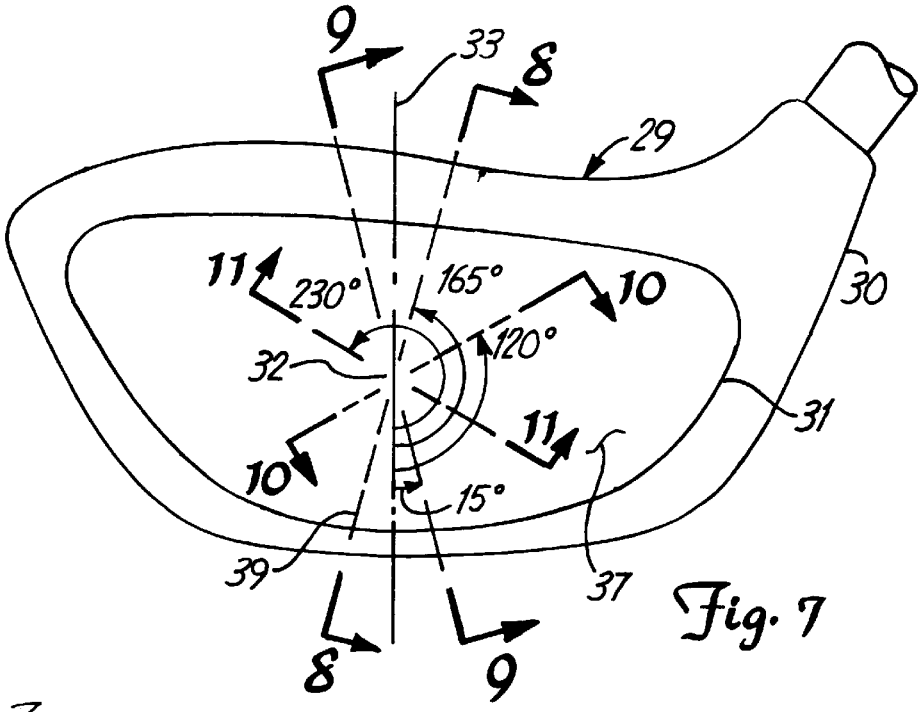
FIG. 7 is a front view of a typical golf club called a "wood" (usually now made of metal).

This equation defines the cross sectional shape of the cylinder. Elements of the cylinder are oriented at an angle called TH measured with respect to a vertical reference plane. TH is indicated in FIG. 7 by the angles between vertical plane 33, below the hit center 32, and the planes shown at 15°, 120°, 165° and 230° counter clockwise, as shown in FIG. 7. The cross sections are illustrated by FIGS. 8, 9, 10 and 11, which are sectional views taken along planes oriented at the shown values of TH. The views are perpendicular to the elements of the cylinder, and the curve of the upper part of the face is defined by the above equation.

The lower part of the club head defines a flat face 34 from the base 31A of the club head (which is adjacent the ground) to the hit center 32. The flat face is at a selected loft angle 36 (LA) from base 31 to hit center 32. The elements of a cylinder are formed on the club face from the hit center to an upper edge 31B of the face, as shown at 37 in FIG. 8, 37A in FIG. 9, 37B in FIG. 10 and 37C in FIG. 11. The flat face portions are also shown at 34A, 342 and 34C in FIGS. 9, 10 and 11, respectively.

The process of obtaining the desired surface is through the systematic adjustment of TH and the constants in the equation. Proper choice of TH and these constants replaces choice of bulge and roll radii in the prior art methods. The choice may be guided by judgment and experience or preferably by analysis. The analysis is an iteration process which is continued until values of TH and the constants are found which give a minimum scatter of stop points. In the case of another shape in place of this exponential example, such shape is expressed mathematically and a similar iteration is used with the constants of its mathematical expressions and TH. The experimental alternate is to choose the values based on experience.

The novel method uses the concept of using a plurality of surfaces which may be described in any of these mathematical ways.

When there is more than one modification surface, a distance z from each of the modification surfaces to the face surface is additive. That is, the various adjustment distances z from the second and later modification surfaces are added to the z distances from the first surface.

For irons and putters, usually one modification surface is sufficient with TH at or near 0°. Additional modification surfaces normally give little or no improvement. By contrast, the putters of U.S. Pat. Nos. 1,615,038 and 5,333,873 could be described in this way and would have TH of 90° and/or 270°.

Figure 10:
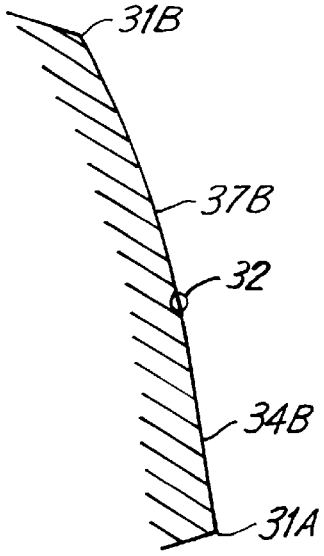
FIG. 10 is a fragmentary sectional view taken on line 10—10 in FIG. 7, which is rotated 120° from the reference plane.
Figure 11:
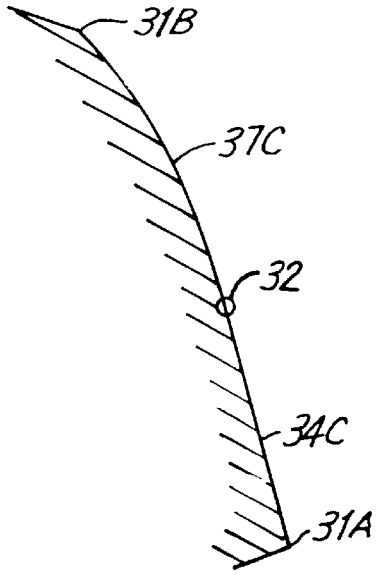
FIG. 11 is a fragmentary sectional view taken on line 11—11 in FIG. 7 and is at an angle of 230° from the reference plane.
Figure 12:
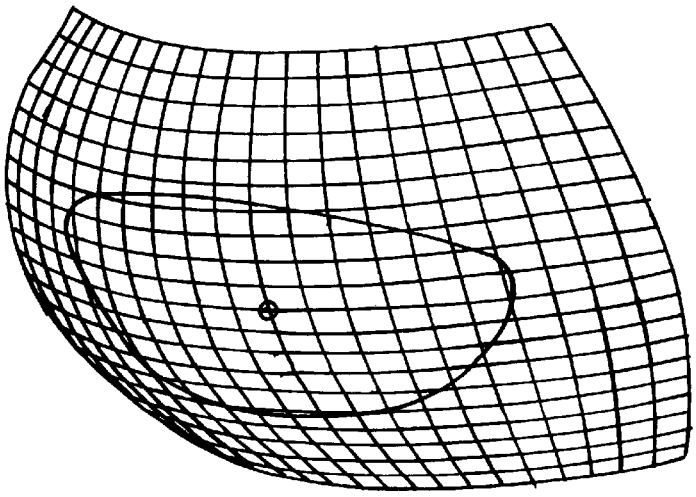
Fig. 12 PRIOR ART
FIG. 12 is a schematic perspective view to a prior art face surface shape based on the equations of a torus.

For woods, two modification surfaces are usually needed, typically one with TH of about 120° and the second with TH of about 230° (FIGS. 10 and 11). A third may make a small effect worthy of considering, and a fourth usually makes an effect small enough to ignore. More may be used for any club face, but at some point additional modification surfaces cause negligible further reduction of the scatter of stop points.

In no case does the normal use of such modification curves cause the final face surface to have areas of concavity.

There is an interesting special case for modification surfaces for irons. A No. 1 iron is or should be normally designed with the best LA and the best center of gravity location for maximum distance, such a value for LA being illustrated at 19 in FIG. 4. A hit above or below the center for such a design will reduce the distance as compared with a flat face. A flat face is best for this case. Face curvature tends to become more important as LA increases.

Figure 6:
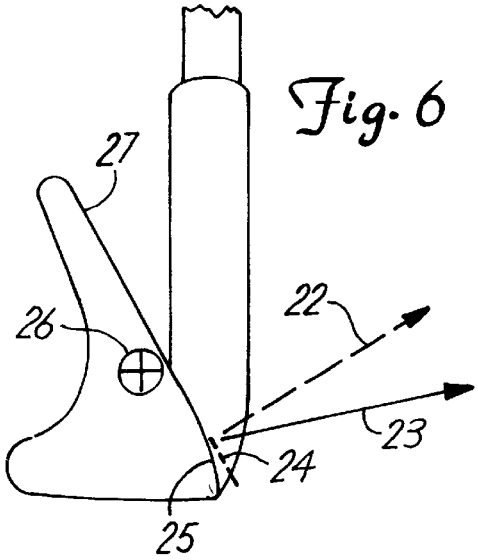
FIG. 6 is an end view of an iron having a face surface made according to the present invention.

FIG. 6 illustrates the nature of the improved face surface shape for an iron. The unmodified (flat) face of a conventional club is shown by the dotted line 24. The center of gravity is shown at 26. A conventional flat face 24 causes the ball to fly off in the direction approximately indicated by dotted arrow 22. The face shape of the present invention includes a curved face portion, shown somewhat exaggerated at 25, and the flat upper portion 27. The curved portion 25, which may be non-circular causes the ball to fly off approximately as shown by solid arrow 23 if the hit is in this region. The curved portion of the cylinder is below the hit center in FIG. 6. Local LA is less for surface 25 at the intersection point of arrow 23 and reduces or eliminates the distance loss which occurs with the flight direction shown by arrow 22 caused by the conventional flat face with a hit below the center hit location.

For poor hits which are partly off the lower edge of an iron, the inventors found that it was often desirable to provide a narrow flat face surface, parallel to the planar or flat portion of the face, which is not apparent in FIG. 6, at the bottom edge of the curved portion 25.

For putters, the optimum face shape is similar to that for irons. Robot putting tests showed the effect of LA on distance of putts. From data collected the optimum curvature of the lower or upper portion (depending on center of gravity location) was derived and the other portion of the face was left flat. The procedure is similar to that described above for irons. For putters, aerodynamic effects are negligible and are ignored.

For woods, the curvature is different from irons mainly because the center of gravity is located much farther back from the face than for an iron.

FIG. 7 is a front view of a typical wood, looking perpendicular to its face at the hit center location. It has a nominally vertical reference plane 33 which passes (or may pass) through its hit center location 32. For illustration of the shape, sight line 8—8 represents an edge view of a plane inclined from the vertical at the angle TH of 165°. This plane is perpendicular to the face at the hit center position 32.

FIG. 8 is the sectional view taken along sight line 8—8 of FIG. 7. Elements in the cylindrical modification surface are made to be perpendicular to the plane which is defined in FIG. 7 by line 8—8. This means that FIG. 8 is a view parallel to the elements of the modification surface. FIG. 8 thus displays the shape of a modification surface which is representative of woods. The same is true of the cross sections of FIGS. 9, 10 and 11, which are taken on the respective sight lines shown in FIG. 7, at the identified TH angles.

Discussion of Resulting Shapes

A physical explanation of the behavior of a hit toward the toe or heel has been rather widely known and understood. Such a hit causes the ball to spin about an axis which deviates somewhat from horizontal, an effect commonly called side spin. Side spin is absent when the center of gravity is in or near the face as for irons. When the ball flies through the air, side spin gives rise to horizontal aerodynamic forces which cause the ball to curve toward the right or toward the left, (slices or hooks in common terminology) depending on the amount of side spin, which way the spin axis is tilted, the ball speed, and other factors.

Side spin is well known and for many years, approximate corrections which are also well known have been made by using bulge radii as defined above to substantially reduce the lateral errors of stop points which result from hits toward the toe or heel. The method of defining modification surfaces described here provides more effective suppression of errors due to side spin.

The radii of curvature for woods using the present invention are usually greater than for irons, but are of comparable magnitude. The result is that the face is curved mainly in the area toward the heel from the face center and somewhat upward and also toward the toe and somewhat upward.

These modification surfaces for woods tend to give a resulting face shape which has a triangular shaped flat or nearly flat area in the downward direction from the face center, unlike irons, and is mainly curved in areas which are up and toward the toe and up and toward the heel.

For putters, the procedure differs mainly in that the stop point of putts involves short, simple flight. The bounce and roll part of the relation is important for putters. As before, the best values of parameters for the modification surface were found which minimize the scatter of stop points. The resulting face surface shape is similar to that of irons.

Summary of Points of Novelty

The novel shape of the face surface results in smaller scatter of stop points as compared with prior art surface shapes. The prior art design method requires choosing the optimum bulge and roll radii. The novel method requires choosing other parameters.

The face surface shapes described for irons, woods, and putters have minimum radii of curvature which are asymmetrical in various points of the surface, quite different from the symmetry of prior art surfaces. Deviations from a plane which is tangent to the face at the hit center, also are asymmetrical.

The smallest radius of curvature measured at various points on the face surface varies in quite different ways for the novel face surface from that of prior art surfaces. This may be compared by study of the ratios of two such radii of curvature at various defined points on the surface. A flat area of a face has a ratio of 1.00 or very nearly so, differing from 1.00 mainly because of normal manufacturing tolerances. Technically, perfectly flat faces would have a ratio of infinity divided by infinity which is not defined. Actual faces are not perfectly flat and they have ratios very near to 1.00.

Although the present invention has been described with reference to preferred embodiments, workers skilled in the art will recognize that changes may be made in form and detail without departing from the spirit and scope of the invention.

What is claimed is:

1. A golf club head having a curved hitting face surface which is convex and which has a face surface shape so chosen as to minimize the variations of the locations of points where golf balls stop after a plurality of hits by a given golfer, such hits being scattered over said face, a hit center comprising a preferred location of hits, a dividing plane perpendicular to said face surface at said hit center, said dividing plane oriented at any or all angle relative to a vertical plane between 15° and 165°, said face being asymmetrical with respect to said dividing plane.

2. A golf club head having a curved hitting face surface, said face being free of concavity, said face having a hit center comprising a preferred location of hits, and said face having a shape so chosen as to minimize the variations in locations of points where golf balls stop after a plurality of hits by a given golfer, which are scattered over said face, a tangent plane tangent to said face surface at said hit center, a mid plane perpendicular to said tangent plane and intersecting it in a horizontal line which passes through said hit center, a vertical plane perpendicular to said tangent plane and located at a predetermined toe-heel distance from said hit center, a first minimum radius of curvature of said face shape measured at said predetermined toe-heel distance and at an up-down predetermined distance measured in said tangent plane above said mid plane, a second minimum radius of curvature of said face shape measured at an equal up-down distance measured in said tangent plane below said mid plane, said first and second radii of curvature differing for each other, for all such predetermined toe-heel and up-down distances so long as said radii are measured at points which are within the perimeter of said face.

3. The club head of claim 2 in which the ratio of the smaller of the first and second minimum radii of curvature to the larger is between zero and 0.8.

4. The club head of claim 2 in which said predetermined toe-heel distance is zero.

5. The club head of claim 4 in which the ratio of said smaller of the first and second minimum radii of curvature to the larger is between zero and 0.8.

6. The club head of claim 2 in which said hit center is midway between the toe and heel ends of said face surface, said midway distance and said hit center being determined midway between a selected upper boundary of centers of hits and a selected lower boundary of centers of hits.

7. A golf club head having a convexly curved golf club face surface having a hit center comprising a preferred location of hits and having a front face surface formed relative to a reference tangent plane tangent to said face surface at the hit center and measuring plane which is perpendicular to said tangent plane, said measuring plane intersecting said tangent plane and said face surface, at said preferred location said face surface being formed at segments spaced distances from the tangent plane measured perpendicular to said tangent plane to said face surface segments at points which are at predetermined distances from said hit center, the distances measured perpendicular to said tangent plane being different at predetermined distances in one direction from the same predetermined distance in an opposite direction, said predetermined distances being within the periphery of said club face and measured in a plurality of measuring planes oriented at selected directions about a line perpendicular to the tangent plane and passing through the hit center, said distance to the face surface measured perpendicular to the tangent plane providing a face shape chosen so as to reduce scatter of stop points of a golf ball hit with said golf club.

8. The club head of claim 7 wherein the ratio of a smaller of said distances measured perpendicular to the tangent plane to that of a larger of said distances measure perpendicular to the tangent plane when the smaller and larger distances are measured at the same predetermined distance in the same measuring plane is between zero and 0.7.

9. The club head of claim 8 wherein said ratio is between zero and 0.85.

10. The club head of claim 7 wherein said golf club head positioned near a normal ball address position when said measurements of distances are made.

11. A method of finding an optimum face surface shape for golf club head in which the club face surface joins a base of a club head and extends upwardly as an imaginary flay surface oriented at a prescribed loft angle, comprising determining the stop points of a plurality of hits scattered over said face surface, and adjusting the shape of said imaginary flat surface by an iteration process, until the adjusted shape provides a face surface having a minimum scatter of said stop points; said iteration process comprises defining a first modification face surface shape which has the form of a modified flat surface at a prescribed loft angle on one side of a point on said face surface, and at which point is tangent to a cylindrical shape on the opposite side of said point, generating elements of said cylindrical shape oriented at an angle about an axis perpendicular to said modified flat surface at said point and defined by different distances from an extension of said modified flat surface, and determining the stop points of a plurality of hits scattered over said first modification face surface, adjusting said cylindrical shape and said angle on said first modification surface shape so as to minimize the scatter of said stop points.

12. The method of claim 11 including the further step of forming a second modification surface shape to portions of the first modification surface and adjusting the shape and orientation angle of only said second modification surface shape so as to minimize the scatter of stop points when said face surface shape is the defined combination of said first and second modification shapes.

13. The method of claim 12 including the steps of repeating the process of determining the stop points of a plurality of hits scattered over said face surface shape with a plurality of additional similarly defined modification face surface shapes in which each similarly defined modification face surface shape adds adjustment to all preceding modification surface shapes, until such additional surface shapes cause negligible further reduction of scatter of said stop points.

14. The method of claim 11 in which said cylindrical surface shape is defined by an intersection of said cylindrical surface with an intersecting plane perpendicular to said cylindrical surface shape and said intersection shape is selected from a group of curves consisting of shapes which are circular, parabolic, elliptical, hyperbolic, exponential, and as defined by an algebraic series such as $$z=a0+a1*y\hat{}1+a2*y\hat{}2+ - - - +an*y\hat{}n$$

where a0, a1, . . . an are constants, "*" means to multiply and "^" means to raise to the power indicated, n is a number as large as preferred, y is the distance from the hit center in a plane tangent to the face at the hit center, and z is the adjustment distance from said extension of said imaginary flat surface.

15. The method of claim 11 in which said cylindrical surface shape is defined by an intersection of said cylindrical surface with an intersecting plane perpendicular to said cylindrical surface shape and said intersection shape is one shape from a group consisting of circular, parabolic, elliptical, hyperbolic, and exponential shape.

* * * * *

UNITED STATES PATENT AND TRADEMARK OFFICE

CERTIFICATE OF CORRECTION

PATENT NO. : 6,139,445
DATED : October 31, 2000
INVENTOR(S) : Frank D. Werner

It is certified that error appears in the above-identified patent and that said Letters Patent is hereby corrected as shown below:

Column 13,
Line 22, cancel "flay" and insert -- flat --.

Signed and Sealed this

Twenty-eighth Day of May, 2002

*Attest:*

*Attesting Officer*

JAMES E. ROGAN
*Director of the United States Patent and Trademark Office*